US006582052B2

(12) United States Patent
Sarmast et al.

(10) Patent No.: US 6,582,052 B2
(45) Date of Patent: Jun. 24, 2003

(54) PEN ALIGNMENT USING A COLOR SENSOR

(75) Inventors: Sam Sarmast, Vancouver, WA (US); Tod S. Heiles, Vancouver, WA (US); Algird M. Gudaitis, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/238,860

(22) Filed: Sep. 9, 2002

(65) Prior Publication Data

US 2003/0016978 A1 Jan. 23, 2003

Related U.S. Application Data

(63) Continuation of application No. 09/817,713, filed on Mar. 26, 2001, now abandoned.

(51) Int. Cl.[7] ..... B41J 29/393
(52) U.S. Cl. ..... 347/19; 347/43; 101/486
(58) Field of Search ..... 347/19, 43; 101/485, 101/486; 358/504

(56) References Cited

U.S. PATENT DOCUMENTS 4,675,696 A * 6/1987 Suzuki ..... 347/19
5,748,221 A * 5/1998 Castelli et al. ..... 347/232
6,065,400 A * 5/2000 Van Weverberg ..... 101/181
6,419,340 B1 * 7/2002 Wickham et al. ..... 347/15

* cited by examiner

*Primary Examiner*—Huan Tran
*Assistant Examiner*—Blaise L Mouttet

(57) ABSTRACT

A pen alignment method for a multi-pen printer is provided, the method including directing a first pen to print a first pattern of a first color, directing a second pen to print a second pattern of a second color in a predetermined relative alignment with the first pattern to form a test block, determining an actual hue of the test block via spectral analysis of the test block using a color sensor, and comparing the actual hue of the test block with an expected hue of the test block to determine whether the first and second pens are misaligned relative to each other, wherein the expected hue of the test block is the hue that would be detected if the first pen and second pen were correctly aligned.

16 Claims, 3 Drawing Sheets

70
71
72
73
74
75
76
77
78

80
81
82
83
84
85
86
87
88

90
91
92
93
94
95
96
97
98

100
101
102
103
104
105
106
107
108

PEN ALIGNMENT USING A COLOR SENSOR

CROSS REFERENCE TO RELATED APPLICATION(S)

This is a continuation of application Ser. No. 09/817,713 filed on Mar. 26, 2001 abandoned, which is hereby incorporated by reference herein.

FIELD OF THE INVENTION

The present invention relates generally to printers and more particularly, to a method and system for aligning pens of a color printer based on the detected hue of overlapping test patterns.

BACKGROUND

Typically, four-color ink-jet printers have replaceable print cartridges providing cyan (C), yellow (Y), magenta (M) and black (K) ink printing. In such printers, four separate color cartridges are provided, rather than providing them in a mono-block configuration. Precise alignment among the various print cartridges, or pens, is required to produce high quality print without noticeable dot misregistration, color variegation or other undesirable visual effects. Thus, in a four-color printer wherein a black ink pen and three color ink pens are provided in the form of separate pens, alignment between the independent, and possibly slightly misaligned, pens is required. Such inter-pen or inter-color misalignment, of course, is not limited to the case where the various pens are physically separate, as misalignment may result from dimensional tolerances in the manufacture of, for example, a mono-block pen having two or more integrated print cartridges and associated ink droplet outlets or nozzles. In any event, the present invention arises from recognition of the fact that such misalignment, or misregistration, between two or more ink pens can be adjusted for by a shift of the virtual image as between the two colors prior to printing.

Previous methods for making such alignment adjustments generally have been limited to two classes of solutions. The first class of solutions requires user intervention and interaction, and typically involves printing a series of patterns on media and then requiring the user to identify which pattern is best aligned. This solution is limited in accuracy in that the user is depended upon to pick the best calibration value. The second class of solutions requires the use of an optical measurement system that monochromatically reads bars and lines printed by all of the print heads. This solution is limited in that only using one light source diminishes the ability to accurately scan all the colors. For example, if a blue illuminant is used, detection of cyan ink suffers.

There is a need for an accurate, inexpensive method of pen alignment for multi-pen color printers that does not require user input.

SUMMARY

A pen alignment method for a multi-pen printer is provided, the method including directing a first pen to print a first pattern of a first color, directing a second pen to print a second pattern of a second color in a predetermined relative alignment with the first pattern to form a test block, determining an actual hue of the test block via spectral analysis of the test block using a color sensor, and comparing the actual hue of the test block with an expected hue of the test block to determine whether the first and second pens are misaligned relative to each other, wherein the expected hue of the test block is the hue that would be detected if the first pen and second pen were correctly aligned.

DETAILED DESCRIPTION

Figure 1:
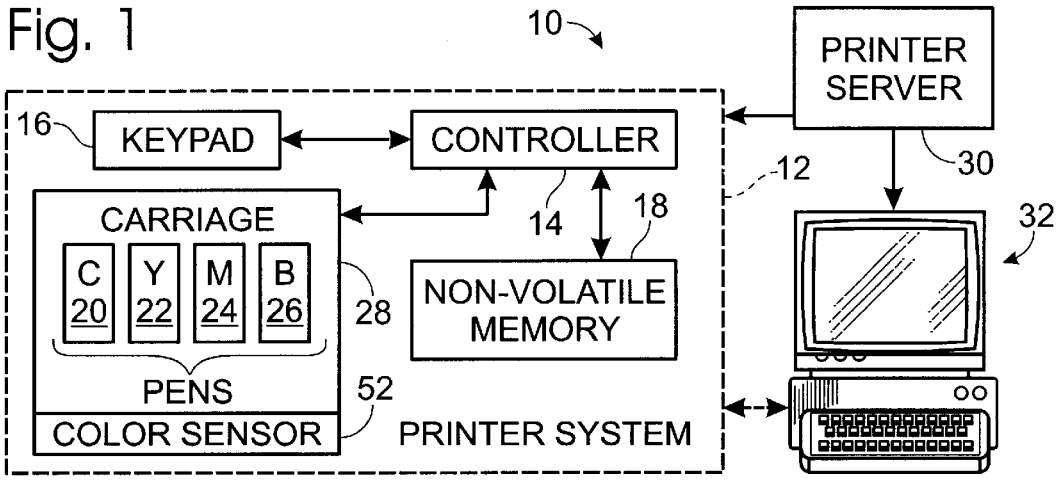
FIG. 1 is a printer system block diagram that schematically illustrates a computer workstation including a multi-pen color printer system.

Referring first to FIG. 1, a computer workstation is schematically indicated in block diagram form at 10. Computer workstation 10 may be seen to include a printer system 12 including a printer controller 14 operatively coupled with a control console keypad 16, non-volatile memory 18, and four, different-color pens 20, 22, 24, and 26 mounted, for example, on a reciprocating carriage 28. As used herein, the term "pen" refers to pens, printheads, print cartridges, or any other device used to place a marking onto media.

Those of skill in the art will appreciate that reciprocal movement of carriage 28, and firing of pens 20, 22, 24, and 26, are controlled by controller 14 to place ink droplets on a conventional print medium, a paper feed motor and opposing rollers (FIG. 2) advance. This printer provides a setting for description of the present invention below. It should be understood, however, that the present invention is not limited to those printers using four pens, or to printers which employ a reciprocating carriage. The present invention broadly considers the alignment of two or more pens, whatever their form.

Within the spirit and scope of the invention, printer 12 may be instructed to print color images, including text, by an operatively connected printer server 30, to which a personal computer (PC) or terminal 32 is connected. Alternatively, as indicated by a dashed line, printer 12 may be directly operatively connected to PC 32. All such conventional connections and control and monitoring of printer 12—e.g. to a logical printer server, driver or mechanism capable of commanding the printer to print and monitoring its print status—are contemplated, and are within the spirit and scope of the present invention.

Referring still to FIG. 1, it will be understood by those of skill in the art that non-volatile memory 18 may be an integral part of printer controller 14, which may be, for example, a programmed microprocessor, or may be connected thereto over a data and address bus as illustrated in FIG. 1. Those of skill also will appreciate that various conventional printer elements such as drive motors (e.g. servo motors), that control the advancement of print media past the pens and that control the reciprocation of the mounting carriage are not shown in FIG. 1 for the sake of simplicity and brevity but are nonetheless considered. For illustrative purposes herein, pens 20, 22, 24, and 26 may be the primary, or printing process, ink colors: cyan (C); yellow (Y); magenta (M); and black (K). Nevertheless, other colors (e.g. red, green, blue and black) that achieve preferably full visible color spectrum, high-quality printing results also are contemplated, and are within the spirit and scope of the invention. Similarly, 4-color printers, 6-color printers and other multi-color printers are contemplated.

Figure 2:
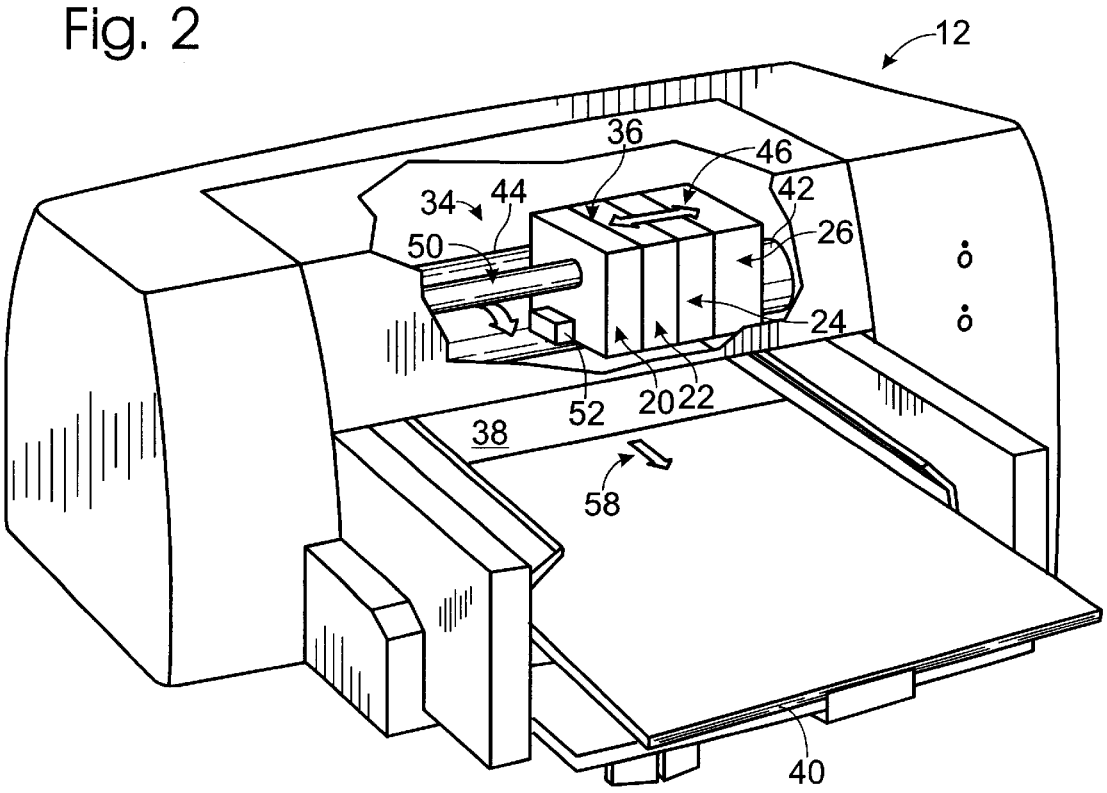
FIG. 2 is an isometric view of a printer configured to employ a pen alignment method and system in accordance with the present invention.

Referring to FIG. 2, a printer is shown generally at 12 including a fragmented view of a media advancement mechanism 34, and a print mechanism 36. Printer 12 is configured to print on media (or media sheets) 38, the media sheets being consecutively fed into a print region using media advancement mechanism 34. As indicated, media advancement mechanism 34 typically includes opposing rollers 42 and 44, which direct media along a media pathway past the pens.

As indicated above, printer 12 may include pens 20, 22, 24, and 26 mounted on a carriage configured to reciprocate transversely (shown by arrows 46 above the pens in FIG. 2), perpendicular to a paper advance direction 58 (shown by the arrow 58 below the pen carriage in FIG. 2). The pens typically are moved back-and-forth by a motor (not shown) along a support rod 50.

A suitable sensor or detector, such as a color sensor 52, is used to review a pattern printed by the pen. As shown, color sensor 52 may be mounted on a pen or pen carriage so as to move transversely across the media with the pen or pen carriage. In the depicted embodiment, the color sensor is positioned upstream of the pen such that any marks printed by a forward-moving pen can be reviewed by the sensor on a single pass of the pen. Alternatively, the sensor may review the printed marks on a return pass, or other subsequent pass of the pen or pen carriage.

The color sensor reviews printed marks on the media by detecting the hue of the printed marks, typically via spectral analysis of the printed marks. It will be appreciated that color sensors typically have multiple channels, and thus, are able to detect multiple wavelengths. Accordingly, color sensors are capable of determining the hue of a printed mark. Sensors such as spectrophotometers, which may have as many as 30 or more channels (and which are capable of detecting visible, ultraviolet and infrared light) are suitable for use in the present invention.

It will be appreciated that color sensor 52 is mounted on the pen carriage with its field of view directed down toward the media surface, allowing it to scan media transversely upon corresponding transverse movement of the pen carriage. Passage of media through the printer allows the color sensor to scan media at various positions along the length of the media, or to scan the media in the direction of media throughput.

Alternatively, color sensor 52 need not be mounted on the printer at all. The color sensor may, for example, be a separate, stand-alone scanner. In this case, the sensor may be a line scanner, a full-size scanner or any other suitable color sensor capable of determining the hue of a mark printed on media.

Figure 3:
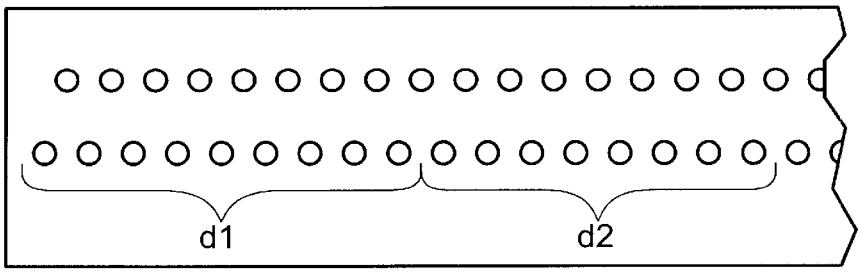
FIG. 3 is an enlarged, fragmentary bottom view of the pen shown in FIG. 2, the pen having plural ink-ejection nozzles.

Referring now to FIG. 3, it will be noted that each pen of printer 12 includes a bottom surface with a plurality of ink-ejection nozzles. When printing, the nozzles are selectively fired such that ink is ejected toward the media to make marks or dots on the media. In FIG. 3, a bottom view of a pen is shown, the pen including a double column of staggered nozzles. Each column of nozzles extends in the y-direction, the direction of the media advance (shown by arrow 58 in FIG. 2). Although FIG. 3 shows only a small number of nozzles, it will be appreciated that a typical pen includes more than 300 nozzles. Actual vertical nozzle spacing is typically approximately 1/600-inch, and each pen may be slightly over one half an inch in length.

During printing, not all nozzles must fire together. Rather, the nozzles are selected such that the appropriate nozzles are fired at the appropriate time, each nozzle making a separate dot. Depending on the arrangement, and on spacing of the nozzles, various print jobs may require different types of firings to produce desired colors or print font.

For the disclosure herein, the pen has been split into two separate groups of nozzles, $d_1$ and $d_2$, as illustrated by two representative bracketed groups of nozzles in FIG. 3. The first group of nozzles $d_1$ is positioned in a first region that is above the second group of nozzles $d_2$, such that group $d_1$ is configured to print on the media in a first region above a second region where the second group of nozzles $d_2$ prints (during a single pass.) The representation is not intended to limit the number of nozzles per group, nor is it meant to identify which nozzles belong to which group.

The timing of the firing of the nozzles must be exact to produce the correct colors or print font. Occasionally nozzles get partially or completely clogged, causing the nozzle to misfire or not fire at all. Printers thus often contain cleaning mechanisms to remove any dried ink or other debris that could contribute to clogging. Additionally, an entire pen may move out of alignment relative to another pen, causing the dots produced from the misaligned pen to be out of alignment with the dots produced from the aligned pen. The misalignment may be corrected by physically moving the pen, by reallocating nozzles, or by adjusting the firing times of the nozzles in the misaligned pen.

Figure 4:
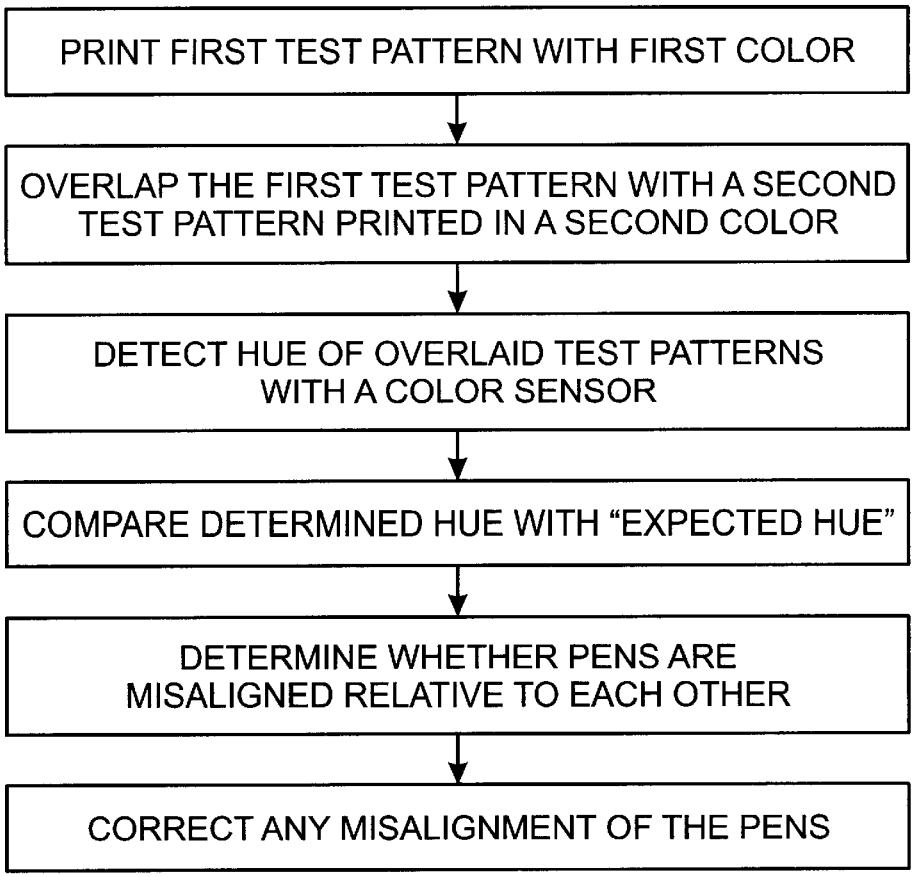
FIG. 4 is a flowchart depicting an embodiment of the present invention.

Having described the various printer-related components above, the disclosed pen alignment process will now be described generally in reference to the flow diagram shown in FIG. 4. First, at least two differently-colored pens print at least one composite test block. Each test block includes a test pattern from one pen, which is to be overlaid with a test pattern from another pen in a predetermined desired alignment. The two test patterns may be printed during the same carriage pass, or the first pattern may be printed in its entirety on one carriage pass and the second pattern printed on another carriage pass. Next, the color sensor may be used to determine the hue of the test block via spectral analysis of the test block. As stated above, the hue that should be detected by a color sensor if the pens are aligned correctly is the "expected hue." The hue of the test block that is actually printed (the "actual hue") is compared with the expected hue for that test block. Variation from the expected hue is an indication of misalignment of the two pens relative to each other.

Figure 5:
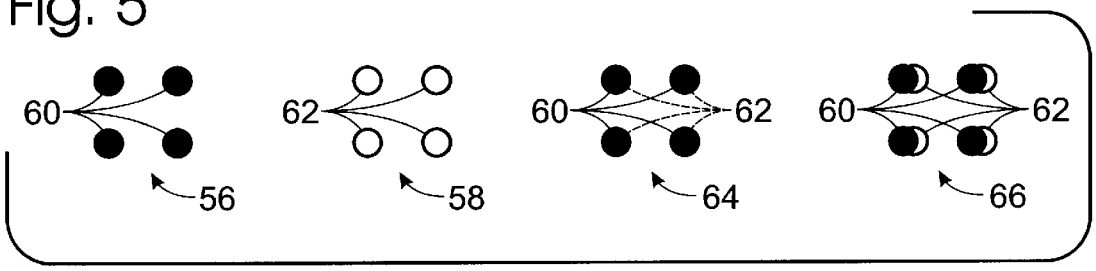
FIG. 5 depicts a pair of conceptualized test patterns, each from a different-color pen, and the test blocks that might result when the patterns are printed to overlap each other.

FIGS. 5 provides a simplified illustration of the present invention using a first test pattern 56 and a substantially identical second test pattern 58, each printed with a different color pen. Pattern 56 may, for example, be printed with the pen containing black ink, and pattern 58 may be printed with the pen containing magenta ink. Test pattern 56 is made up of a plurality of dots 60. Test pattern 58 is made up of a plurality of magenta dots 62. It will be appreciated, however, that the present invention contemplates alignment of any two or more pens, regardless of color. Furthermore, it is to be understood that all pens may be aligned relative to a single reference pen, or relative to successively aligned pens.

When the black pen and the magenta pen are perfectly aligned (relative to each other) test block 64 will be formed from black dots 60 in perfectly overlapping alignment with magenta dots 62. Color sensor 52 thus will not detect any of the magenta dots 62 because the magenta dots are blocked by the black dots 60. For ease of discussion, blocks that the color sensor would detect as black will be described as having a black hue. Thus, since printing the test block with correctly aligned pens in the current example would result in a black hue, the expected hue is black. Now, assuming initially that the pens are directed to print the first test pattern in perfectly overlapping alignment, it will be appreciated that the expected resultant test block will be substantially identical to the first and second test patterns. Accordingly, when the black pen and the magenta pen are misaligned (relative to each other), directing the two pens to print patterns 56 and 58 in perfectly overlapping alignment may result in the magenta dots 62 being shifted relative to the black dots 60, as shown in test block 66. In this case, color sensor 52 will detect a magenta hue because at least some portion of the magenta dots is exposed. Because the expected hue is black, detection of any hue other than black indicates misalignment of the pens.

Those of skill in the art will appreciate that while FIG. 5 shows test patterns 60 and 62 as having patterns of 4 dots arranged in 2×2 patterns, the test patterns may be of any size, shape or configuration. Furthermore, it will be understood that the test pattern shown in FIG. 5 is meant to be exemplary, and not limiting.

In some embodiments, the pens are directed to print a series of test blocks, each characterized by a different expected relative alignment of the underlying test patterns. Each test block thus has an expected hue based on the expected relative alignment of the underlying test patterns. The hue of each test block in the series, in combination with the order of the hues, creates a hue signature. The actual hue signature, as detected by a color sensor, thus can be compared with an expected hue signature, based on the expected hue of each test block, to identify the type and extent of pen misalignment in the printer. With this information, the processor may make appropriate adjustments to the nozzles to correct for the misalignment.

Figures 6A, 6B, 6C, 6D:
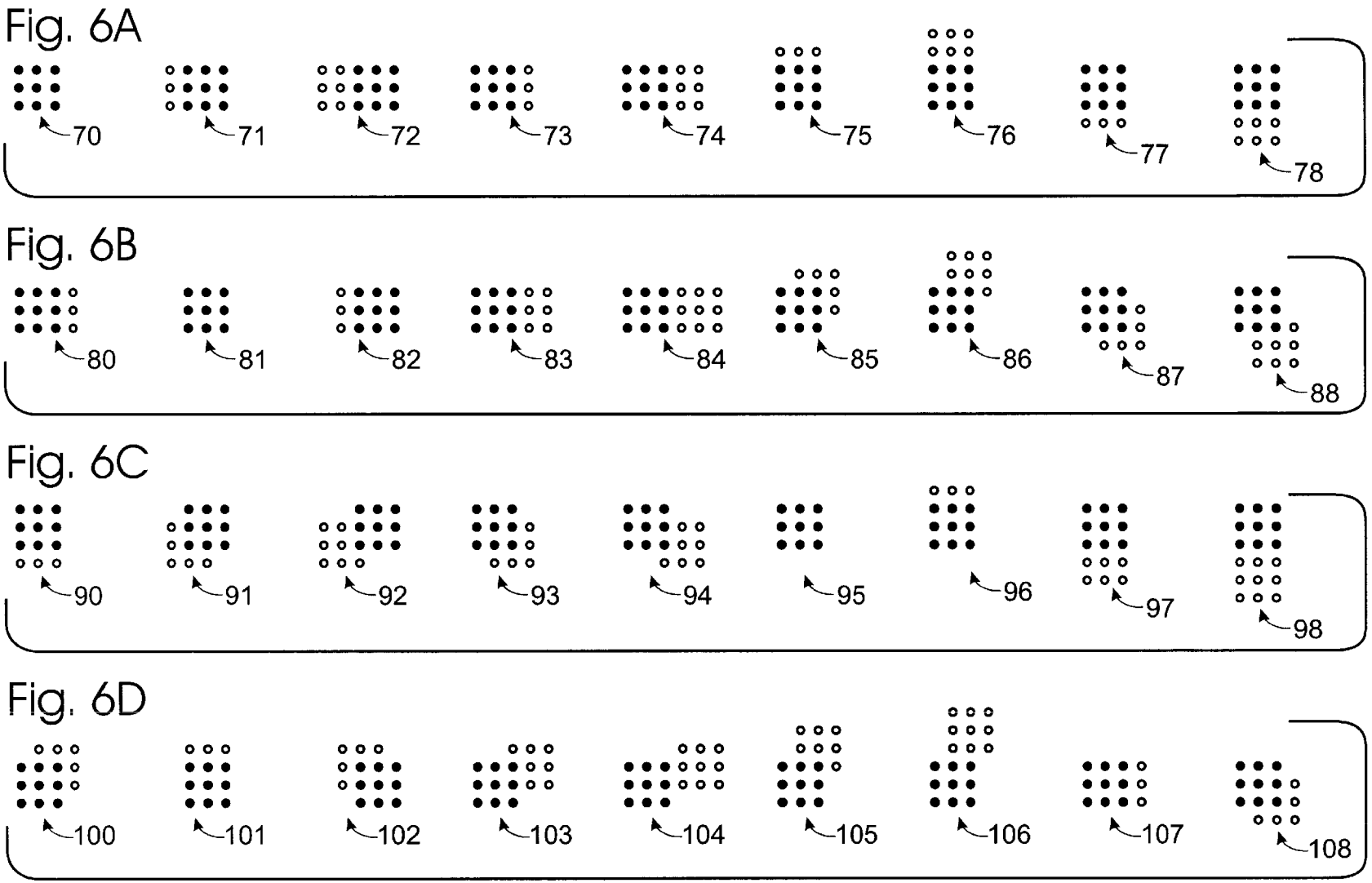
FIGS. 6A–6D depict four conceptualized test block series demonstrating various states of pen alignment/misalignment.

An example of the types of test blocks that might be created is depicted, for example in FIG. 6A. The exemplary series of test blocks is created by overlapping black test patterns with magenta test patterns in various relative positions. Although any two colors may be used, when one of the pens is black, it is preferable that one of the test patterns be printed with the black pen. Each pattern is created by printing nine dots, arranged in a three by three pattern. In each test block of the test block series, the magenta test pattern is shifted relative to the black test pattern in differing direction and/or degree. Although relative shift of the magenta test pattern is shown for clarity to coincide with the spacing between dots the test blocks need not be so limited. Correspondingly, pen misalignment, as demonstrated in FIGS. 6B–6D, need not be limited to misalignments resulting in relative shift of a test pattern so as to coincide with the spacing between dots.

Focusing now on FIG. 6A, it is to be understood that test blocks 70–78 represent a hue signature printed with pens that are perfectly aligned relative to each other. Therefore, the hue resulting from each test block is the expected hue for that test block. Furthermore, the hue resulting from each test block in the series of test blocks 70–78 and the order of those hues is the expected hue signature for the series of test blocks 70–78.

For example, in test block 70, the magenta test pattern is printed exactly over the black test pattern. In test block 71, the magenta test pattern is intentionally shifted to the left of the black test pattern by one dot width (e.g. 1/600-inch). In test block 72, the magenta test pattern is intentionally shifted to the left of the black test pattern by two dot widths. Though not depicted, additional test patterns could be included where the magenta dot is intentionally shifted by three, four, or more dot widths. In addition, it is not necessary for the shift to be a full dot width. In some embodiments the shift may be less than one dot width. In general, the degree of shift may be determined according to the printer's ability.

Returning to FIG. 6A, in test block 73, the magenta test pattern is intentionally shifted to the right of the black test pattern by one dot width. In test block 74, the magenta pattern is intentionally shifted to the right of the black test pattern by two dot widths. In test block 75, the magenta pattern is intentionally shifted upwardly from the black test pattern by one dot width. In test block 76, the magenta pattern is intentionally shifted upwardly from the black test pattern by two dot widths. In test block 77, the magenta pattern is intentionally shifted downwardly from the black test pattern by one dot width. In test block 78, the magenta pattern is intentionally shifted downwardly from the black test pattern by two dot widths.

When scanned with a color sensor, the actual hue of blocks 71–78 is magenta in comparison to the black actual hue of block 70. Depending on the amount of the magenta pattern that is exposed, some blocks are more magenta in hue than others. For example, blocks 72, 74, 76 and 78 each have six exposed magenta dots. These blocks will be more magenta in hue than blocks 71, 73, 75, and 77, which only have three magenta dots exposed. If we were to assign a degree of the magenta hue (from 0–9) based on the number of dots in the magenta pattern that are exposed, test block 70 would be a 0, test block 71 a 3, test block 72 a 6, test block 73 a 3, test block 74 a 6, test block 75 a 3, test block 76 a 6, test block 77 a 3 and test block 78 a 6. As will be appreciated, the color sensor would actually be determining the degree of the magenta hue based on the overall hue of the block. The order of these hues makes up the expected hue signature, thus the hue signature of test blocks 70–78 would be 0, 3, 6, 3, 6, 3, 6, 3, 6.

Comparison of the determined hue signature with the expected hue signature allows for identification of misalignment of the printer. FIGS. 6B–6D depict actual hue signatures of variously misaligned pen pairs.

For example in FIG. 6B, if the magenta pen is shifted right relative to the black pen, the test blocks, as printed, might look like those depicted in blocks 80–88. As will be appreciated, test block 80 will be detected as more magenta in hue than test block 70 due to the shift of the magenta pen. This is because more of the magenta test pattern is exposed, allowing more magenta color to be detected by the color sensor. However, while test block 71 has a magenta hue because the magenta test pattern is shifted to the left relative to the black test pattern, test block 81 has a black hue because the right shift of the pen compensates for the left shift of the test pattern. In accordance with the aforementioned assumptions, the hue signature for blocks 80–88 would be 3, 0, 3, 6, 9, 5, 7, 5, 7. Thus, it could be determined that a printer that printed this test block series, and produced hue signature of 3, 0, 3, 6, 9, 5, 7, 5, 7 would have a magenta pen that is shifted right by the width of one dot relative to the black pen. The magenta pen could be physically moved, the nozzles could be reallocated, or the nozzles could be directed to adjust their timing to compensate for the downward shift.

In FIG. 6C test blocks 90–98 depict what a series of test blocks might look like if the magenta pen was shifted down relative to the black pen. As will be appreciated, test block 95 is black because the downward shift of the pen is compensated for by the upward shift of the test pattern. Using the convention described above, the hue signature for blocks 90–98 would be 3, 5, 7, 5, 7, 0, 3, 6, 9. This hue signature indicates that the magenta pen is shifted down relative to the black pen. Again, the magenta pen could be physically moved, the nozzles reallocated or the nozzles could be directed to adjust their timing to compensate for the downward shift.

In FIG. 6D, test blocks 100–108 depict what a series of test blocks might look like if the magenta pen was shifted both up and to the right relative to the black pen. As will be appreciated, none of the test blocks are completely black.

In accordance with the aforementioned convention, the hue signature for test blocks 100–108 would be 5, 3, 5, 7, 9, 7, 9, 3, 5. As before, obtaining this hue signature would indicate the type of alignment and the pen could be adjusted accordingly to correct the misalignment.

As will be appreciated, one pen may be shifted in any direction and by any amount relative to the other pen. However, because each misalignment creates a unique hue signature, within limits, identification of the hue signature allows for identification of the type and degree of misalignment affecting the printer. The degree of misalignment that can be detected is limited only by the ability of the printer to accurately overlap the dots and the ability of the scanner to detect the hue variations. If each dot in the test patterns above is assumed to be a single dot from a single nozzle, each dot may be as small as 1/600 of one inch.

However, it will be appreciated that the test patterns depicted in FIG. 6A–6D are merely schematic and may be representative of test patterns of any shape or size.

While a variety of test patterns may be selected, preferable test patterns are those where each misalignment to be identified has a unique hue signature. The hue signature of the scanned test blocks is then used to identify the type of misalignment that is affecting the printer.

The test patterns themselves may be specifically shaped to simplify identification of the type of misalignment to be detected. In some cases, test patterns may be used which effectively mask any misalignment in a particular direction. For example, a test pattern including one or more solid horizontal stripes may be used such that any horizontal misalignment is masked and only vertical misalignment is detected.

Figure 7:
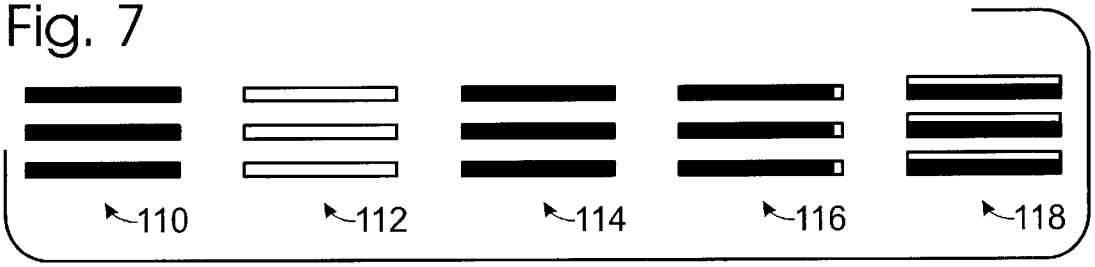
FIG. 7 depicts a conceptualized depiction of horizontal test patterns, and test blocks created therefrom.

In FIG. 7, test pattern 110 is printed by a black pen and includes a plurality of solid horizontal lines. Test pattern 112 is printed by a magenta pen and also includes a plurality of solid horizontal lines. Assuming again that the pens are directed to print the test patterns in perfectly overlapping alignment, the actual resultant test block 114 will have a black hue. When the pens are horizontally misaligned (relative to each other), the actual resultant test block 116 may also be sensed as having a black hue. As will be appreciated, although the edge-most portion of test pattern 112 will be exposed, the color scanner typically is directed to ignore the outer edges of a test block in calculating the hue of the test block. However, when the pens are vertically misaligned (relative to each other), the actual resultant test block 118, will have a magenta hue. As will be appreciated, the more magenta the hue, the greater the degree of vertical misalignment. A second series of test blocks including vertical stripes (not shown) may likewise be used to detect any horizontal misalignment. Occasionally, nozzles will become plugged or jammed and skip a few drops before ink is released. This is problematic for pen alignment methods that rely on a sharp contrast between a printed region and an unprinted region to determine if pen alignment is correct. In one embodiment of the present invention, the color sensor thus ignores the outer edges and scans only the central portion of each test block. Furthermore, hue calculations may be based on the average overall hue of the scanned area of each test block. This can reduce error due to nozzle problems, or other minor variations in the test block.

It will be appreciated that the present disclosure is not limited to detecting pen misalignment. The invention can also be used to identify paper advancement errors. Typically, media is advanced through a printer using a drive roller or feed roller. These generally cylindrical drive rollers advance media through the printer along a media path as the drive roller rotates about a drive shaft driven by a motor. Conventional drive roller mechanisms are susceptible to linefeed errors that cause paper-positioning inaccuracies. With the advent of more complex print jobs, paper-positioning accuracy has become increasingly important. To ensure paper-positioning accuracy, the drive roller advancing mechanism must be regulated to meet increased precision requirements and overcome problems associated with linefeed errors.

Linefeed errors can be characterized in at least two ways, run-out error and diametrical error. Run-out error is due to undesired eccentric rotation of the drive roller. Diametrical error is due to a change in the diameter of the drive roller itself. Both types of error are caused by inaccuracies in the manufacture of drive rollers, and the result causes linefeed advance to be off by increments typically approximating less than 1/600-inch. Accordingly, manufacturing inaccuracies of drive rollers have presented a special problem in view of current printing requirements.

By identifying inaccuracies in media advancement due to the drive roller, the printer may be calibrated such that it adjusts and compensates for such inaccuracies. The alignment methods of the present invention may be used to identify these inaccuracies. To identify a linefeed inaccuracy, a first test pattern is printed on suitable media. The first test pattern is printed in a first color. The media is then advanced with the feed roller such that a second test pattern in a second color may be printed on top of the first. As the paper advances, the second color aligns with the test pattern so that when the second color is fired the second pattern prints on top of the first pattern to create a test block. As previously described above in reference to identification of pen misalignment, a color sensor then detects the hue of the test block. As also previously described above, the detected actual hue is compared to an expected hue and any variation of the detected actual hue from the expected hue indicates a linefeed inaccuracy.

For example, the first test pattern may be printed with the lower nozzles of the black pen (i.e. group $d_2$ in FIG. 3). The paper is then advanced and the second test pattern may be printed with the upper nozzles (i.e. group $d_1$, in FIG. 3) of the magenta pen such that, if the linefeed advancement mechanism is working accurately, the magenta and black patterns will perfectly overlap and the color sensor will detect a black hue. Detection of a hue other than black will indicate a linefeed inaccuracy.

As with the pen alignment example, it will be understood that the test patterns and test blocks used may be of any shape or size, so long as the color sensor is able to detect the overall average hue of the test block and discriminate between aligned test patterns and unaligned test patterns based on the hue of the test block.

In one embodiment, a processor is used to store the information produced by the color sensor, identify any misalignment detected, and make any necessary adjustments. The processor may be part of the printer or may be part of the hardware to which the printer is attached.

What is claimed is:

1. A pen alignment method for a multi-pen printer, the method comprising:

directing a first pen to print a first pattern of a first color;

directing a second pen to print a second pattern of a second color in a predetermined relative alignment with the first pattern to form a test block;

determining an actual hue of the test block via spectral analysis of the test block using a color sensor; and comparing the actual hue of the test block with an expected hue of the test block to determine whether the first and second pens are misaligned relative to each other, wherein the expected hue of the test block is the hue that would be detected if the first pen and second pen were correctly aligned.

2. The pen alignment method of claim 1, further comprising forming a series of test blocks having a plurality of first test patterns and a plurality of second test patterns corresponding to the first test patterns, wherein the second test patterns are selectively shifted relative to the corresponding first test patterns.

3. The pen alignment method of claim 1, wherein the color sensor is mounted for movement with the first pen and second pen to determine actual hue of the test block.

4. The pen alignment method of claim 1, wherein the first color is black and the second color is not black.

5. The pen alignment method of claim 1, further comprising adjusting a nozzle firing time to correct the determined misalignment.

6. The pen alignment method of claim 1, further comprising adjusting a nozzle firing pattern to correct the determined misalignment.

7. A pen alignment method for a printer having a first pen of a first color and a second pen of a second color, the method comprising:

directing the first pen and the second pen to print a series of test blocks having differing expected hues;

determining an actual hue signature for the series of test blocks printed by scanning the series of test blocks with a spectrophotometer to detect an actual hue of each test block in the series of test blocks; and comparing the actual hue signature with an expected hue signature, wherein the expected hue signature is the hue signature that would be detected if the pens were aligned correctly.

8. The pen alignment method of claim 7, wherein the expected hue signature is selected to identify direction of misalignment.

9. The pen alignment method of claim 7, wherein the expected hue signature is selected to identify degree of misalignment.

10. The pen alignment method of claim 7, further comprising adjusting a timing of pen nozzle firing to correct for misalignment.

11. The pen alignment method of claim 7, further comprising adjusting a pattern of pen nozzle firing to correct for misalignment.

12. The pen alignment method of claim 7, wherein at least one of the test blocks includes a first pattern printed by the first pen and a second pattern printed by the second pen wherein the second pen is intended to completely overlap the first pattern; and at least one of the test blocks includes a first pattern printed by the first pen and a second pattern printed by the second pen wherein the second pattern is intended to only partially overlap the first pattern.

13. The pen alignment method of claim 7, wherein the first color is black and the second color is not black.

14. A pen alignment system comprising:

a printer having first and second pens, each pen having a plurality of nozzles configured to print a test block including a first color test pattern printed by the first pen and a second color test pattern printed by the second pen;

a spectrophotometer configured to detect the hue of the test block via spectral analysis;

a processor capable of interpreting data from the color sensor to identify whether the first and second pens are misaligned by comparing the detected hue with an expected hue, the expected hue being a hue which would be detected if the first and second pens were correctly aligned.

15. The pen alignment system of claim 14, wherein the processor is configured to adjust firing time of the plurality of nozzles to correct pen misalignment.

16. The pen alignment system of claim 14, wherein the processor is configured to adjusting firing pattern of the plurality of nozzles to correct pen misalignment.

* * * * *